US009095188B2

(12) United States Patent
Cavaliere

(10) Patent No.: US 9,095,188 B2
(45) Date of Patent: Aug. 4, 2015

(54) ADJUSTABLE HEEL SUPPORT MEMBER FOR ARTICLE OF FOOTWEAR

(75) Inventor: Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 470 days.

(21) Appl. No.: 13/023,676

(22) Filed: Feb. 9, 2011

(65) Prior Publication Data

US 2012/0198721 A1 Aug. 9, 2012

(51) Int. Cl.

| | |
|---|---|
| ***A43B 3/26*** | (2006.01) |
| ***A43B 23/08*** | (2006.01) |
| ***A43B 23/28*** | (2006.01) |
| ***A43B 7/14*** | (2006.01) |
| ***A43B 7/24*** | (2006.01) |
| ***A43B 23/14*** | (2006.01) |
| ***A43B 23/16*** | (2006.01) |

(52) U.S. Cl.

CPC ... *A43B 7/14* (2013.01); *A43B 3/26* (2013.01); *A43B 7/24* (2013.01); *A43B 23/08* (2013.01); *A43B 23/14* (2013.01); *A43B 23/16* (2013.01); *A43B 23/28* (2013.01)

(58) Field of Classification Search

CPC ..... A43B 3/26; A43B 23/088; A43B 23/28
USPC ..... 36/92, 97, 105, 68, 69
See application file for complete search history.

(56) References Cited

U.S. PATENT DOCUMENTS

| | | | | |
|---|---|---|---|---|
| 178,387 | A | | 6/1876 | Simpson |
| 256,030 | A | | 4/1882 | Morton |
| 912,579 | A | | 2/1909 | Krech et al. |
| 1,091,704 | A | | 3/1914 | Preble |
| 2,935,798 | A | | 5/1960 | Piberhofer |
| 2,942,359 | A | | 6/1960 | Bushway et al. |
| 3,192,651 | A | * | 7/1965 | Smith ..... 36/105 |
| 3,425,075 | A | | 2/1969 | Murray |
| 3,613,274 | A | | 10/1971 | Willey |
| 4,308,673 | A | | 1/1982 | Mobius |
| 4,969,277 | A | * | 11/1990 | Williams ..... 36/97 |
| 5,152,082 | A | | 10/1992 | Culpepper |
| 5,152,084 | A | * | 10/1992 | Bonnaventure ..... 36/118.9 |
| 5,291,671 | A | | 3/1994 | Caberlotto et al. |
| 5,408,761 | A | | 4/1995 | Gazzano |

(Continued)

FOREIGN PATENT DOCUMENTS

| | | |
|---|---|---|
| EP | 2204102 | 7/2010 |
| FR | 2534116 | 4/1984 |

(Continued)

OTHER PUBLICATIONS

International Search Report and Written Opinion dated Sep. 25, 2012 in International Application No. PCT/IB2012/000212.

(Continued)

*Primary Examiner* — Khoa Huynh
*Assistant Examiner* — Sharon M Prange
(74) *Attorney, Agent, or Firm* — Plumsea Law Group, LLC

(57) ABSTRACT

An adjustable heel support member includes a base portion and an extended portion. The extended portion comprises a lateral portion, a medial portion and a rearward portion. The heel support member further includes a fastening member that can be used to adjust the lateral portion, the medial portion and the rearward portion to resize the heel support member. In some cases, the fastening member may be an elastic ring.

19 Claims, 13 Drawing Sheets

(56) References Cited

U.S. PATENT DOCUMENTS

| | | | | |
|---|---|---|---|---|
| D386,895 | S | 12/1997 | Hatfield | |
| 5,699,629 | A * | 12/1997 | Munschy | 36/97 |
| 5,946,825 | A | 9/1999 | Koh et al. | |
| 6,000,148 | A | 12/1999 | Cretinon | |
| 6,079,128 | A | 6/2000 | Hoshizaki et al. | |
| 6,189,239 | B1 * | 2/2001 | Gasparovic et al. | 36/102 |
| 6,295,743 | B1 * | 10/2001 | Brooks | 36/105 |
| 6,401,366 | B2 | 6/2002 | Foxen et al. | |
| 6,622,401 | B2 | 9/2003 | Carroll, III | |
| 7,059,069 | B2 | 6/2006 | Raluy et al. | |
| D535,812 | S | 1/2007 | Matis et al. | |
| 7,743,531 | B2 * | 6/2010 | Aveni et al. | 36/105 |
| D619,348 | S | 7/2010 | Schwartz et al. | |
| 7,757,412 | B2 | 7/2010 | Farys | |
| 7,793,438 | B1 * | 9/2010 | Busse et al. | 36/105 |
| 2005/0081404 | A1 | 4/2005 | Hurd et al. | |
| 2005/0267775 | A1 | 12/2005 | Willis | |
| 2006/0010718 | A1 | 1/2006 | Auger et al. | |
| 2008/0148600 | A1 | 6/2008 | Aveni et al. | |
| 2008/0301974 | A1 * | 12/2008 | Bowen et al. | 36/7.6 |
| 2010/0199522 | A1 * | 8/2010 | Hwang | 36/102 |

FOREIGN PATENT DOCUMENTS

| | | |
|---|---|---|
| GB | 163641 | 5/1921 |
| WO | 8808678 | 11/1988 |
| WO | 2004043184 | 5/2004 |

OTHER PUBLICATIONS

Invitation to Pay Additional Fees mailed Jul. 10, 2012 in International Application No. PCT/IB2012/000212.

International Preliminary Report on Patentability (including Written Opinion of the ISA) mailed Aug. 22, 2013 in International Application No. PCT/IB2012/000212.

* cited by examiner

ADJUSTABLE HEEL SUPPORT MEMBER FOR ARTICLE OF FOOTWEAR

BACKGROUND

The present embodiments relate generally to an article of footwear, and in particular to an adjustable heel support member for an article of footwear.

SUMMARY

In one aspect, a heel support member for an article of footwear includes a base portion, a first side portion extending from the base portion, a second side portion extending from the base portion and a rearward portion extending from the base portion. The first side portion is spaced apart from the rearward portion and the second side portion is spaced apart from the rearward portion. A fastening member extends from the first side portion to the second side portion and the fastening member engages the rearward portion and provides tension between the first side portion, the rearward portion and the second side portion.

In another aspect, a heel support member for an article of footwear includes a first side portion extending from the base portion and a second side portion extending from the base portion, where the second side portion is disposed opposite of the first side portion. The first side portion being spaced apart from the second side portion. A fastening member includes a first portion and a second portion. The first portion is engaged with a first fastener receiving portion on the first side portion and the second portion is engaged with a second fastener receiving portion on the second side portion. The first portion can be disengaged from the first fastener receiving portion.

In another aspect, a heel support member for an article of footwear includes a base portion, an extended portion extending from the base portion and an elastic ring including a first portion and a second portion. The first portion is attached to a first region of the extended portion and the second portion is attached to a second region of the extended portion. The elastic ring provides an adjustable fit for the heel support member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
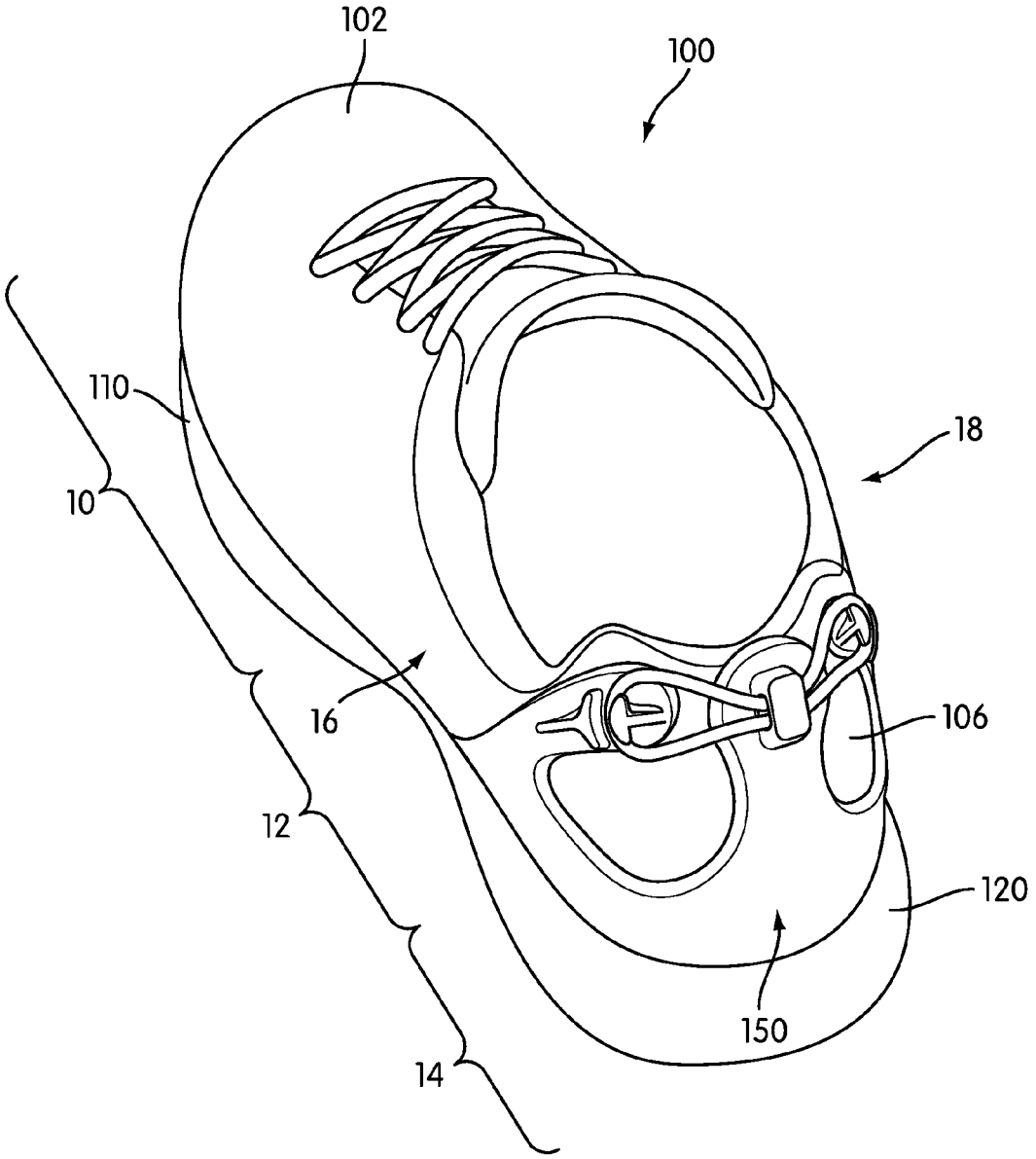
FIG. 1 is a rear isometric view of an embodiment of an article of footwear including an adjustable heel support member.

FIG. 1 illustrates a rear isometric view of an exemplary embodiment of article of footwear 100, also referred to simply as article 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. It will be understood that the principles discussed for article of footwear 100 could be used in articles intended for use with a left and/or right foot.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure. In some cases, each of these directional adjectives may be applied to a heel counter for an article of footwear, as discussed below.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support for an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 120.

In some cases, midsole 120 may be attached directly to upper 102. In other cases, midsole 120 may be attached to a sockliner associated with upper 102. In different embodiments, midsole 120 may have different material characteristics to provide various levels of comfort, cushioning and/or shock absorption. Examples of different materials that could be used for midsole 120 include, but are not limited to: foam, rubber, plastic, polymers, as well as any other kinds of materials.

In some cases, an outsole may be provided on sole structure 110 to increase traction with a ground surface. Although the current embodiment does not include a separate outsole, other embodiments may include any kind of outsole. An outsole can include one or more tread elements and/or ground penetrating members such as cleats. In some cases, an outsole can have different material characteristics to provide varying levels of traction with a ground surface. Examples of different materials that could be used for an outsole include, but are not limited to: plastic, rubber, polymers, as well as any other kinds of materials that are both durable and wear-resistant.

An article of footwear can include provisions for supporting the heel of a foot. In some embodiments, an article of footwear can include a heel support member, such as a heel counter. A heel counter may be disposed adjacent to the sides and/or rear of the heel. In some cases, a heel counter helps maintain the foot inside of the article of footwear and can help to reduce over-pronation.

In some embodiments, article of footwear 100 may include heel support member 150, also referred to as simply support member 150. In some cases, heel support member 150 could be a heel counter. In other cases, however, heel support member 150 may be any other kind of support member known in the art for supporting the heel of a foot.

In different embodiments, heel support member 150 can be associated with different components of article 100. For example, in some cases, support member 150 may be associated with upper 102. In other cases, support member 150 may be associated with sole structure 110. In still other cases, support member 150 could be associated with upper 102 and sole structure 110.

Figure 2:
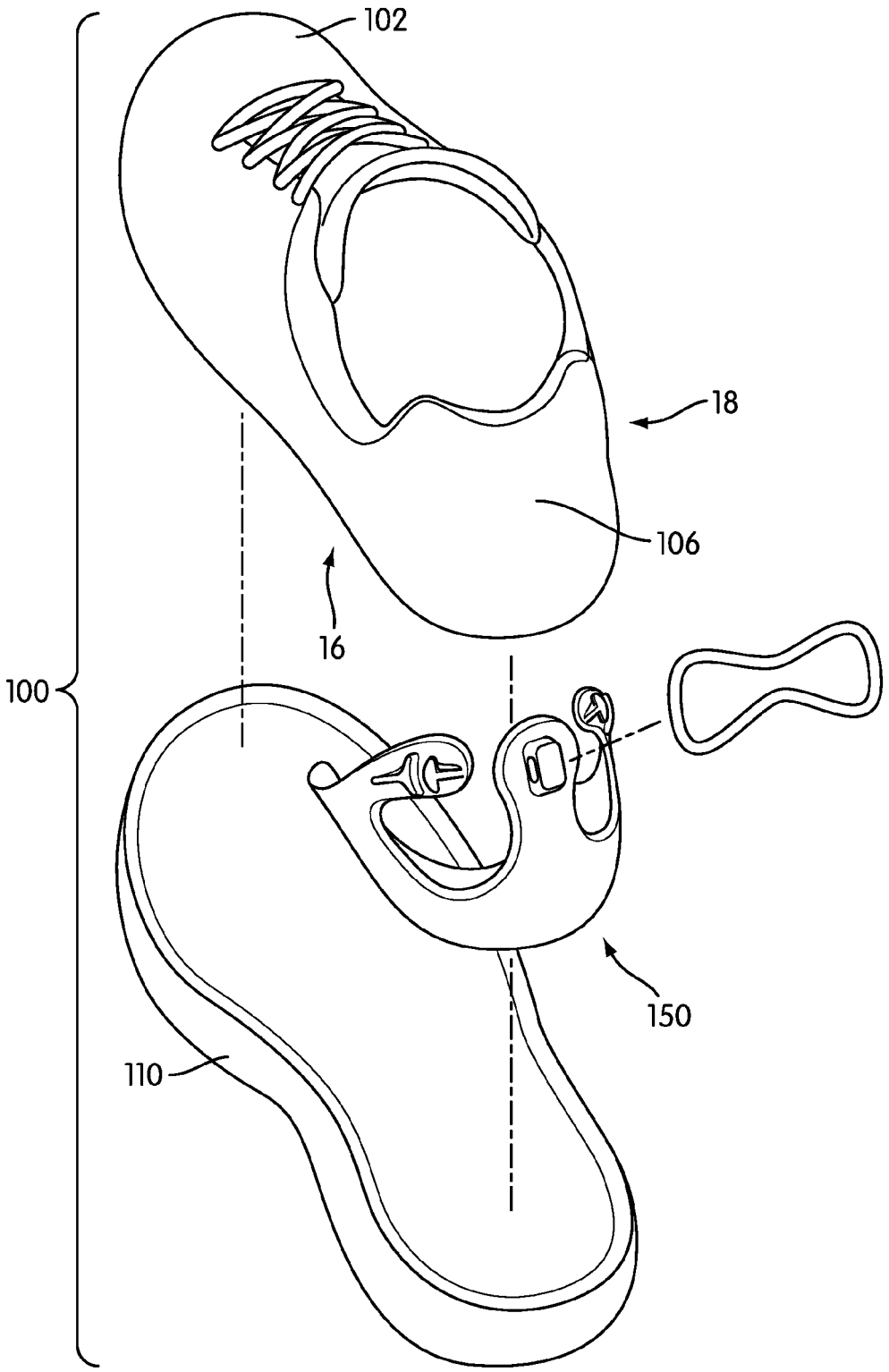
FIG. 2 is an exploded isometric view of an embodiment of an article of footwear including an adjustable heel support member.

FIG. 2 illustrates an exploded isometric view of an embodiment of article 100. Referring to FIGS. 1 and 2, in some embodiments support member 150 may be configured to wrap around upper 102, including along lateral portion 16 and medial portion 18 of heel portion 14. In some cases, support member 150 can also wrap around rearward portion 106 of upper 102. Furthermore, some portions of support member 150 may extend over a lower portion of upper 102 (not shown) so that some of support member 150 is disposed between upper 102 and sole structure 110. In embodiments including a sockliner, support member 150 may extend between upper 102 and the sockliner, or between the sockliner and sole structure 110.

In different embodiments, support member 150 could be attached to article 100 using a variety of methods. In some cases, for example, support member 150 could be glued, or otherwise bonded to, portions of upper 102 as well as portions of sole structure 110. In other cases, support member 150 could be stitched to portions of upper 102 and/or sole structure 110. Moreover, support member 150 could be attached to article 100 before or after the assembly of upper 102 and sole structure 110.

Although support member 150 is disposed on an outer surface of upper 102 in the current embodiment, and comprises a distinct and separate component from upper 102, other embodiments could include various other configurations. In another embodiment, support member 150 could be integrated into upper 102. For example, support member 150 could be disposed between two layers that comprise upper 102. In another configuration, support member 150 may be attached to an interior surface of upper 102 so that support member 150 is not visible along the outer surface of article 100.

FIGS. 3 through 7 illustrate various views of heel support member 150. Referring to FIGS. 3 through 7, support member 150 may include base portion 152 and extended portion 160. Base portion 152 comprises a bottom or lower portion for support member 150. In some embodiments, base portion 152 wraps below upper 102 and/or between upper 102 and sole structure 110. In the current embodiment, base portion 152 further includes central gap 153 (see FIGS. 6 and 7) that gives an approximately u-shaped geometry for base portion 152. In other embodiments, however, base portion 152 may not include any gaps. In still other embodiments, base portion 152 could be a substantially solid portion with one or more holes or apertures.

Extended portion 160 may further comprise various portions such as a first side portion, a second side portion and a rearward portion. In some cases, extended portion 160 includes lateral portion 162 that comprises a first side portion, medial portion 164 that comprises a second side portion and rearward portion 166. Lateral portion 162 extends outwardly from lateral peripheral portion 154 of base portion 152. Likewise, medial portion 164 extends outwardly form medial peripheral portion 156 of base portion 152. In particular, in some cases, lateral portion 162 may be disposed opposite of medial portion 164 with respect to a longitudinal axis of support member 150. Moreover, rearward portion 166 extends outwardly from rearward peripheral portion 158 of base portion 152.

Figure 3:
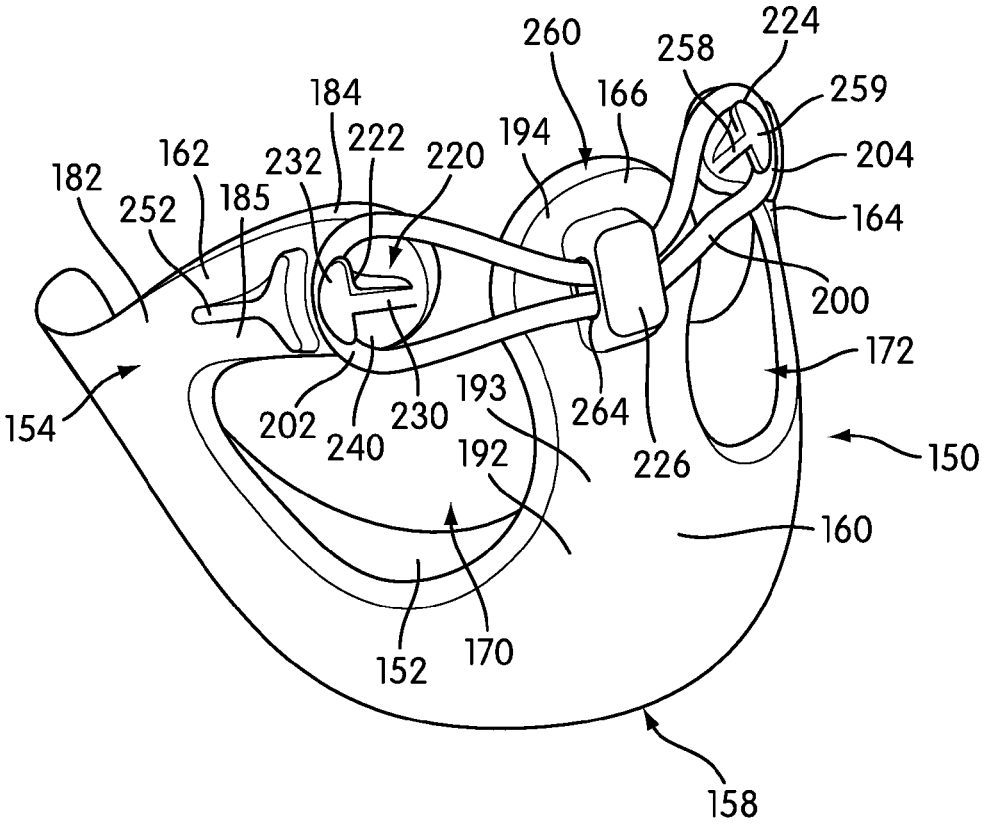
FIG. 3 is a rear isometric view of an embodiment of an adjustable heel member.
Figure 4:
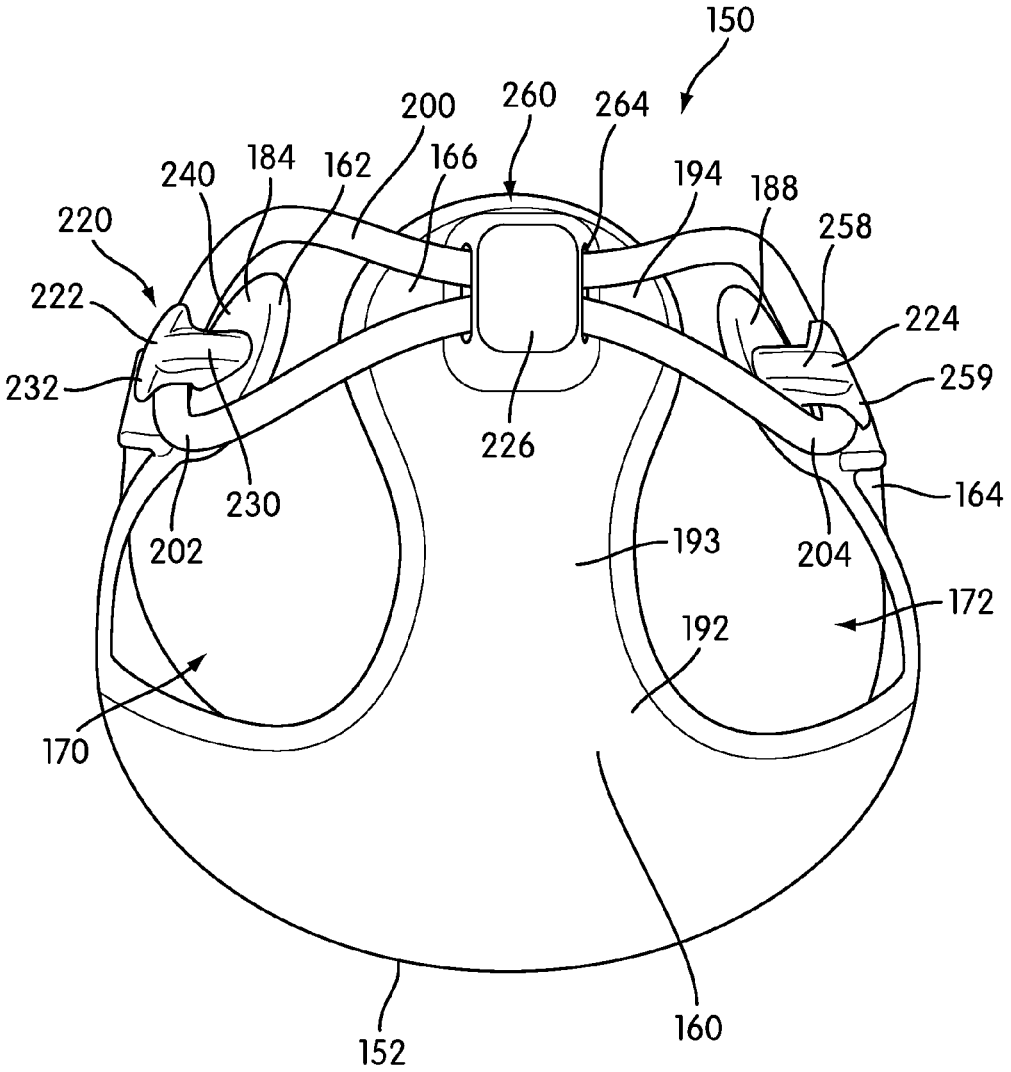
FIG. 4 is a rear view of an embodiment of an adjustable heel member.
Figure 5:
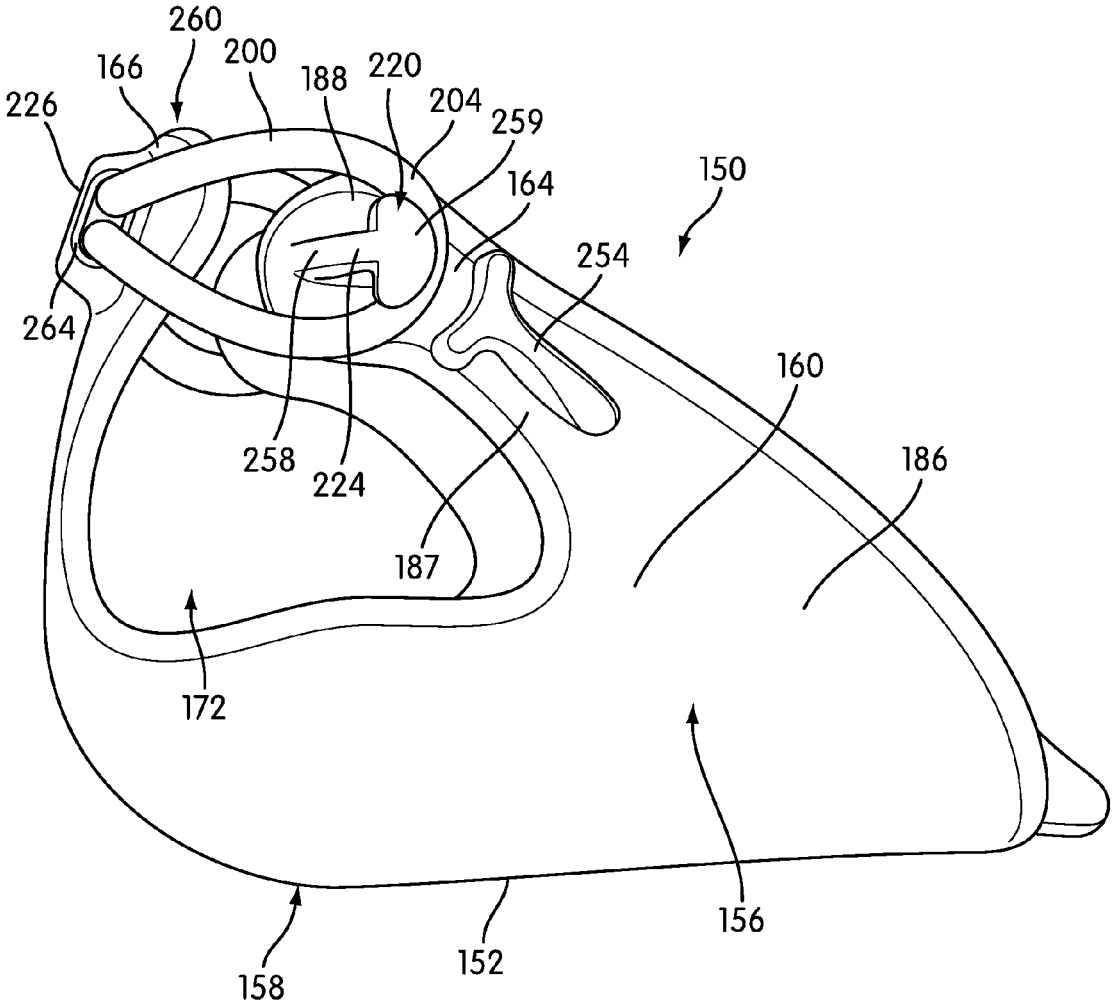
FIG. 5 is a side view of an embodiment of an adjustable heel member.

Generally, the geometry of extended portion 160 can vary. In some cases, each of lateral portion 162, medial portion 164 and/or rearward portion 166 may comprise flap-like portions that are spaced apart by various gaps. Referring to FIG. 3, lateral portion 162 comprises first end portion 182, intermediate portion 185 and a second end portion 184. In some cases, second end portion 184 is substantially wider than intermediate portion 185. Also, as seen in FIG. 5, medial portion 164 comprises first end portion 186, intermediate portion 187 and second end portion 188. In some cases, second end portion 188 is substantially wider than intermediate portion 187. Also, as seen in FIGS. 3 and 4, rearward portion 166 comprises first end portion 192, intermediate portion 193 and second end portion 194, which is substantially wider than intermediate portion 193. These widened end portions may provide additional support near the ankle of the foot.

Referring again to FIGS. 3 through 7, in one embodiment, lateral portion 162 and rearward portion 166 may be spaced apart by first gap 170. Also, in one embodiment, medial portion 164 and rearward portion 166 may be spaced apart by second gap 172. Moreover, second end portion 184 of lateral portion 162 may be disposed closer to rearward portion 166 than first end portion 182. Likewise, second end portion 188 of medial portion 164 may be disposed closer to rearward portion 166 than first end portion 186. In other words, both lateral portion 162 and medial portion 164 generally extend partially in a rearward direction. In addition, in some cases, rearward portion 166 extends in a generally vertical, or proximal, direction.

The current embodiments are only intended to illustrate an exemplary geometry for extended portion 160, including lateral portion 162, medial portion 164 and rearward portion 166. In other embodiments, the geometry of each portion could be varied. Moreover, in other embodiments, extended portion 160 could be divided into more than three portions that are separated by at least three gaps. In still other embodiments, extended portion 160 could be comprised of one portion. In still other embodiments, extended portion 160 could be divided into two portions that are separated by a single gap. For example, in one embodiment, a support member could include a rearward portion and a lateral portion, but not medial portion. As another example, in one embodiment a support member could include a rearward portion and a medial portion, but not a lateral portion. In still another embodiment, a support member could include a lateral portion and a medial portion, but not a rearward portion.

This exemplary configuration for extended portion 160 allows for lateral portion 162, medial portion 164 and rearward portion 166 to act as flap-like supporting portions that bend with respect to base portion 152. This arrangement allows extended portion 160 to expand and/or contract around the heel of a foot.

Support member 150 may be further associated with fastening member 200. Fastening member 200 may generally extend between two or more portions of extended portion 160. In some cases, fastening member 200 may extend between lateral portion 162 and rearward portion 166. In some cases, fastening member 200 may extend between medial portion 164 and rearward portion 166. In other cases, fastening member 200 may extend between lateral portion 162 and medial portion 164. In one embodiment, fastening member 200 may extend between lateral portion 162, rearward portion 166 and medial portion 164. In particular, fastening member 200 may extend from lateral portion 162 to rearward portion 166 and from rearward portion 166 to medial portion 164.

Fastening member 200 could be any provision used for fastening one or more portions of support member 150 around the heel of a foot. In some cases, fastening member 200 could comprise a strip, strap, string, cord or other fastening member having a distinct first end and a second end. In other cases, fastening member 200 could comprise a ring, band or loop-like fastening member. Furthermore, the elasticity properties of fastening member 200 could vary in different embodiments. In some cases, fastening member 200 could have a low elasticity associated with various types of plastic, leather and/or woven straps. In other cases, fastening member 200 could have a high elasticity associated with various types of extendable straps, elastic bands (such as rubber bands) as well as other types of elastic fastening members known in the art. In one embodiment, fastening member 200 comprises a substantially elastic ring.

Referring now to FIGS. 3 through 5, support member 150 can include provisions for receiving fastening member 200. Support member 150 can include fastener receiving portions 220. Fastener receiving portions 220 include first fastener receiving portion 222 and second fastener receiving potion 224. In particular, first fastener receiving portion 222 is associated with second end portion 184 of lateral portion 162. Likewise, second fastener receiving portion 224 is associated with second end portion 188 of medial portion 164. Although first fastener receiving portion 222 and second fastener receiving portion 224 are disposed on end portions of lateral portion 162 and medial portion 164, respectively, in other embodiments each fastener receiving portion could be disposed on any other portions of lateral portion 162 and/or medial portion 164.

In different embodiments, the geometry of a fastener receiving portion could vary. In some cases, first fastener receiving portion 222 may have a hook-like geometry that is configured to hold fastening member 200 in place. In one embodiment, first fastener receiving portion 222 includes connecting portion 230 and engaging portion 232. Connecting portion 230 is a relatively narrow portion that extends outwardly from surface 240 of lateral portion 162 and secures engaging portion 232. Engaging portion 232 may be spaced apart from surface 240 of lateral portion 162 so that fastening member 200 can fit between engaging portion 232 and lateral portion 162.

Engaging portion 232 extends in an approximately perpendicular direction from connecting portion 230. In some cases, for example, engaging portion 232 and connecting portion 230 are configured in a T-like shape. Moreover, first fastener receiving portion 222 may be oriented so that connecting portion 230 is disposed more rearwardly along lateral portion 162 than engaging portion 232. Using this arrangement, fastening member 200 may be pulled in tension against first fastener receiving portion 222 and engaging portion 232 may act to prevent fastening member 200 from sliding off of first fastener receiving portion 222.

The geometry for first fastener receiving portion 222 shown here is only intended to be exemplary and in other embodiments, other geometries are also possible. It will be understood that second fastener receiving portion 224 could be provided with a substantially similar geometry to first fastener receiving portion 222. For example, second fastener receiving portion 224 may include connecting portion 258 and engaging portion 259 that are configured in a similar arrangement to connecting portion 230 and engaging portion 232. In other embodiments, however, second fastener receiving portion 224 could have any other geometry. For example, in some cases, second fastener receiving portion 224 could be configured as a closed loop that fixes fastening member 200 in place in a semi-permanent manner.

In some cases, first fastener receiving portion 222 and second fastener receiving portion 224 may be further associated with first raised portion 252 and second raised portion 254, respectively. In some cases, first raised portion 252 and second raised portion 254 may be t-shaped portions that are disposed adjacent to the engaging portions of first fastener receiving portion 222 and second fastener receiving portion 224. In some cases, first raised portion 252 and second raised portion 254 could facilitate aligning fastening member 200 with fastener receiving portions in some embodiments.

Figure 6:
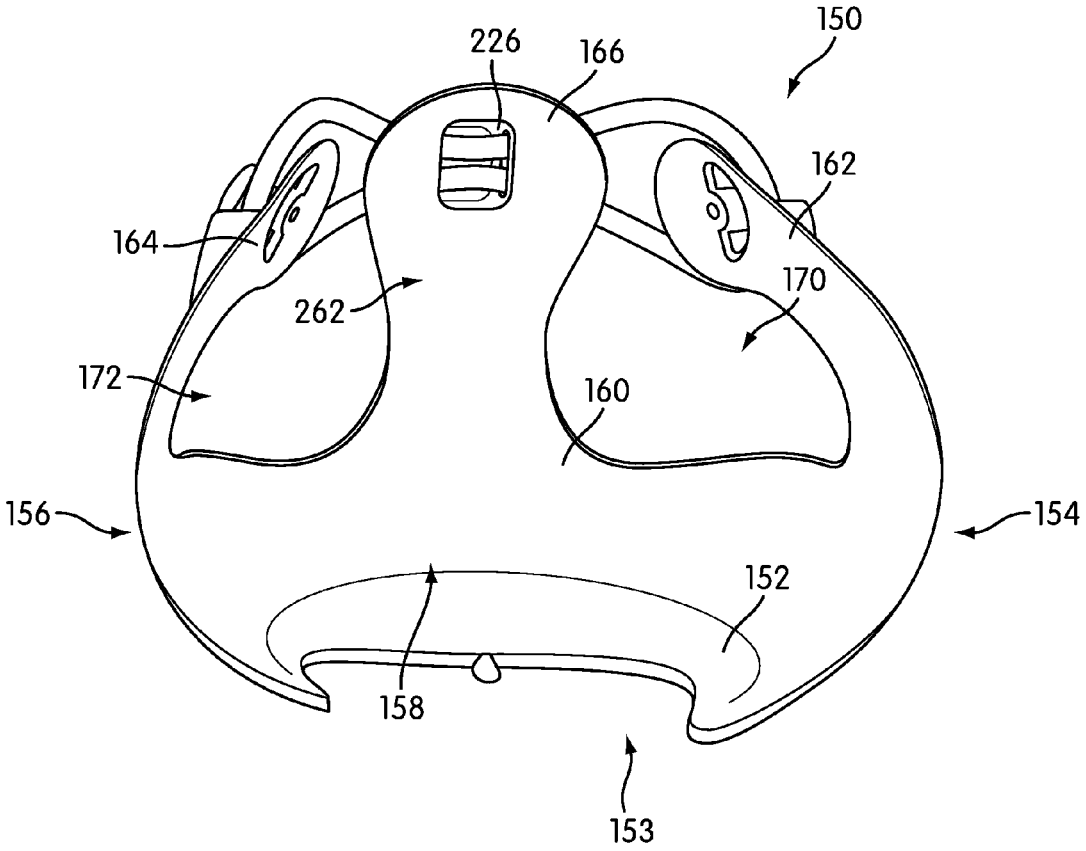
FIG. 6 is a front view of an embodiment of an adjustable heel member.
Figure 7:
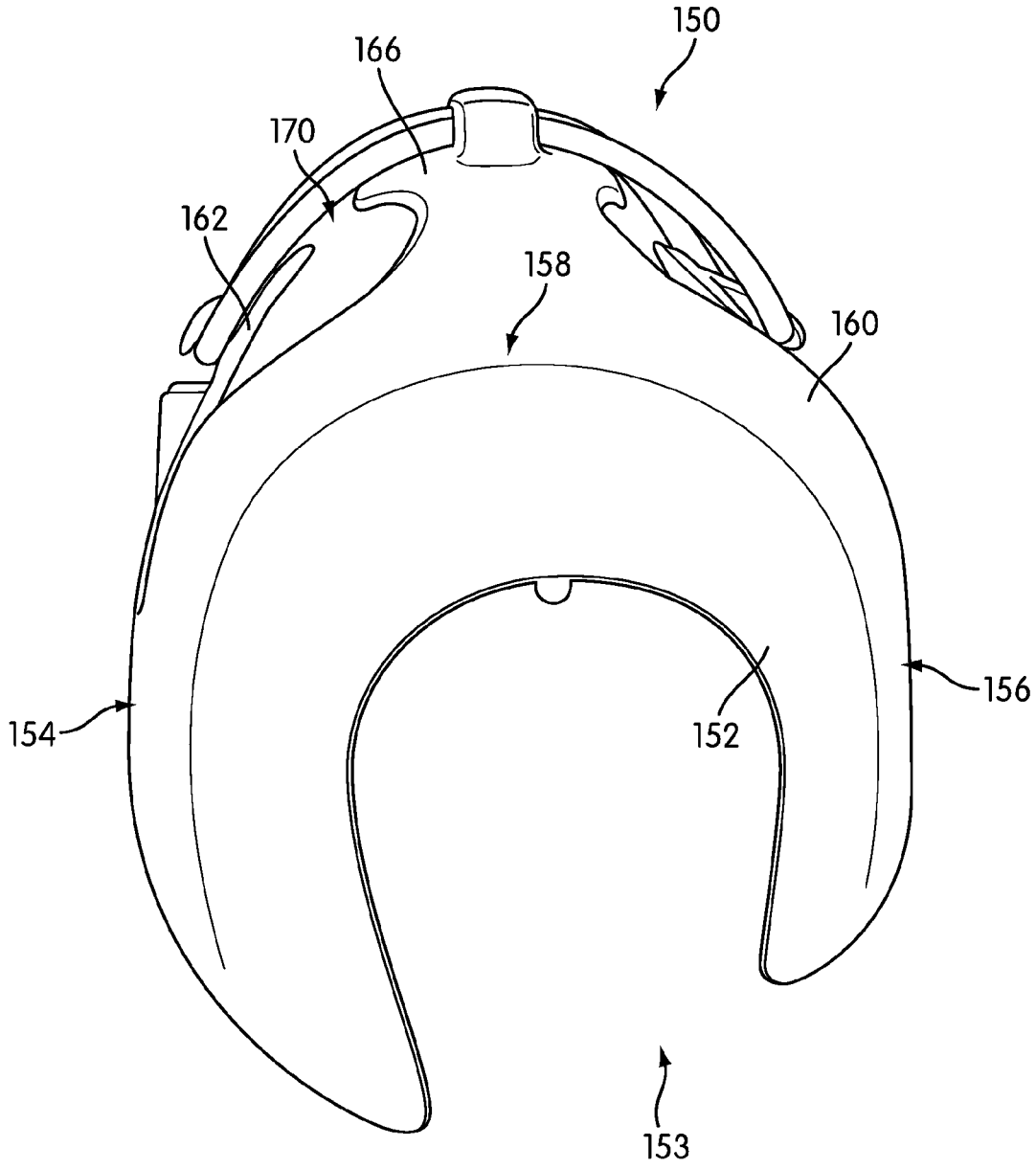
FIG. 7 is a bottom view of an embodiment of an adjustable heel member.

In some embodiments, rearward portion 166 may include third fastener receiving portion 226. In some cases, third fastener receiving portion 226 comprises a raised portion that extends outwardly from outer surface 260 of rearward portion 166. In addition, third fastener receiving portion 226 includes openings 264 for receiving fastening member 200 through opposing sides of third fastener receiving portion 226. As seen in FIG. 6, in some cases, third fastener receiving portion 226 may be substantially hollow and open along inner surface 262 of rearward portion 166.

Using this configuration discussed above, fastening member 200 may be secured through third fastener receiving portion 226 as well as at first fastener receiving portion 222 and second fastener receiving portion 224. In the current embodiment, for example, first portion 202 of fastening member 200 is engaged with first fastener receiving portion 222. In particular, first portion 202 is held in place by engaging portion 232. Also, second portion 204 of fastening member 200 is engaged with second fastener receiving portion 224. In particular, second portion 204 is held in place by engaging portion 259.

Figure 8:
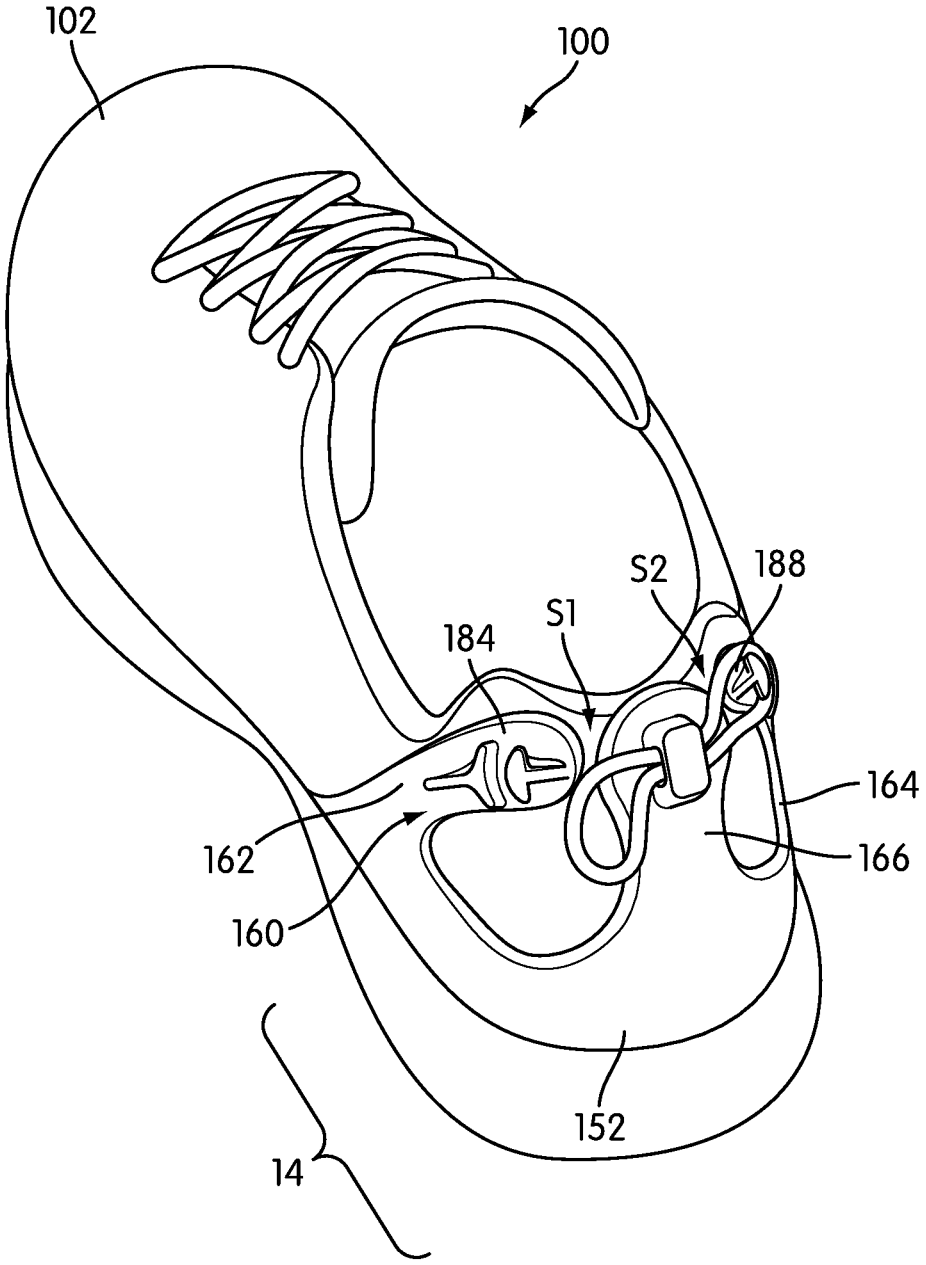
FIG. 8 is a rear isometric view of an embodiment of an adjustable heel member in an unfastened position.

Referring now to FIG. 8, extended portion 160 generally wraps around heel portion 14 of upper 102. In particular, lateral portion 162, medial portion 164 and rearward portion 166 may generally wrap around lateral side 16, medial side 18 and rearward portion 166, respectively. Additionally, portions of base portion 152 may be disposed beneath upper 102 at heel portion 14. This configuration may provide stability and support for a heel disposed inside upper 102.

In the unfastened position shown in FIG. 8, each of lateral portion 162, medial portion 164 and rearward portion 166 may rest against upper 102. Moreover, in this case, second end portion 184 of lateral portion 162 is spaced apart from rearward portion 166 by spacing S1. Similarly, second end portion 188 of medial portion 164 is spaced apart from rearward portion 166 by spacing S2.

Figure 9:
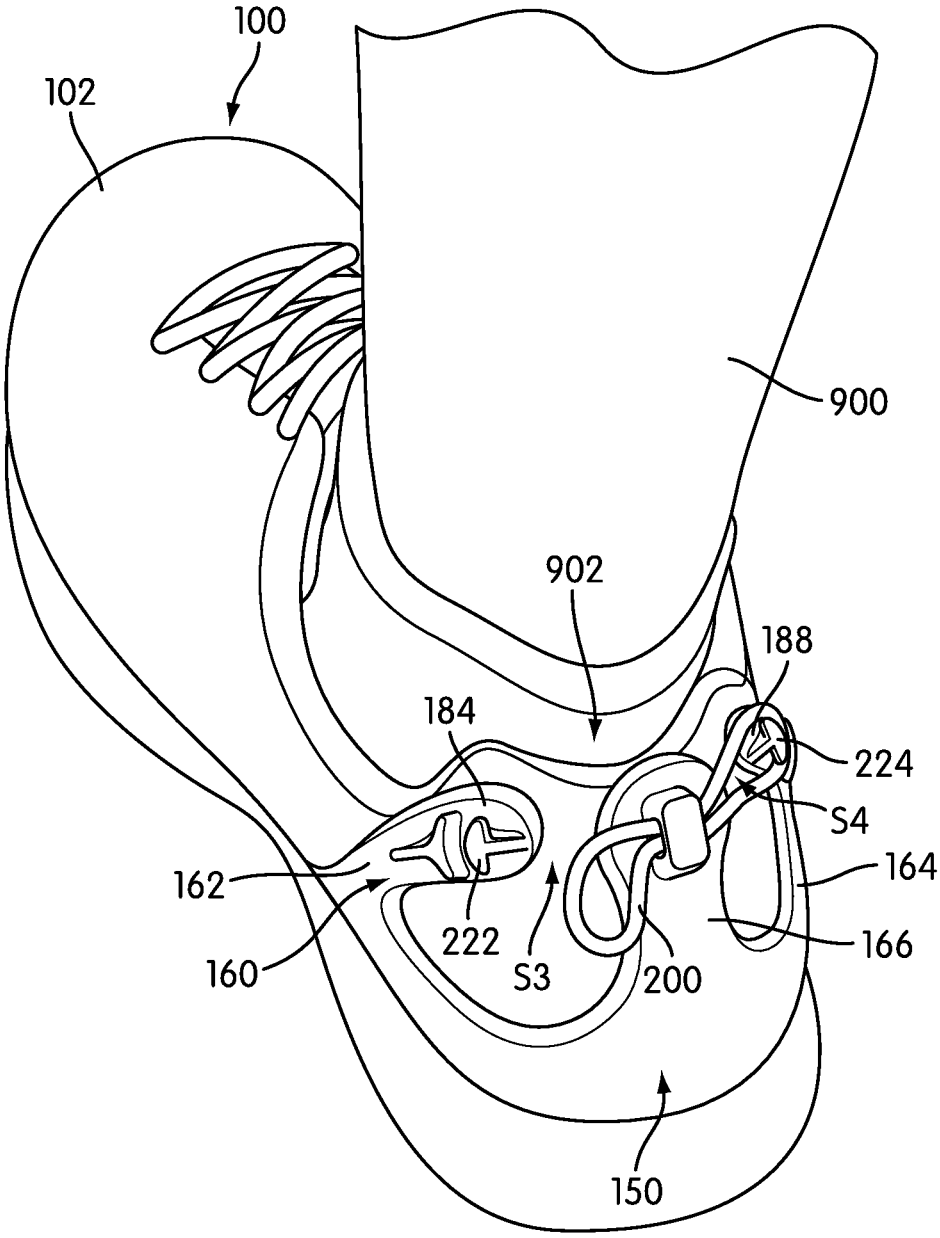
FIG. 9 is a rear isometric view of an embodiment of an adjustable heel member after a foot has been inserted.

Referring now to FIG. 9, foot 900 has been inserted into article 100. As foot 900 is inserted, extended portion 160 flexes to accommodate the width of heel 902 of foot 900. In particular, lateral portion 162 and medial portion 164 are flexed away from rearward portion 166. In this stretched position, second end portion 184 of lateral portion 162 is spaced apart from rearward portion 166 by spacing S3 that is substantially larger than the original spacing S1 shown in FIG. 8. Likewise, second end portion 188 of medial portion 164 is spaced apart from rearward portion 166 by spacing S4 that is substantially larger than the original spacing S2 shown in FIG. 8. In other words, the size of support member 150 may generally change to accommodate the width of a user's foot.

Figure 10:
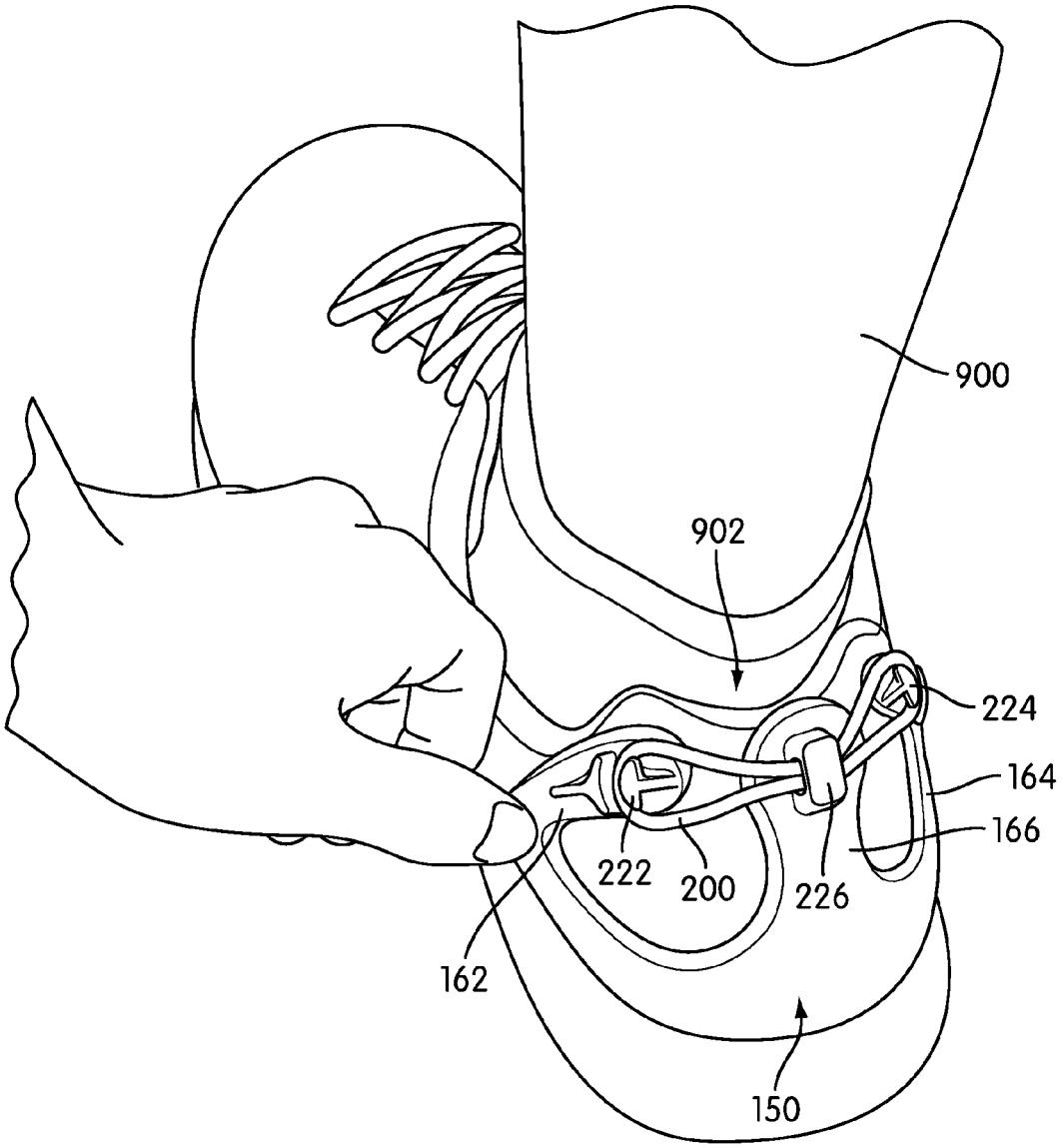
FIG. 10 is a rear isometric view of an embodiment of an adjustable heel member fastened around a foot.

Initially, before support member 150 is tightened, fastening member 200 may only be fastened at second fastener receiving portion 224, but not first fastener receiving portion 222. Referring to FIG. 10, in order to tighten support member 150 around heel 902, a user may pull fastening member 200 over first fastener receiving portion 222, so that fastening member 200 is pulled taut from medial portion 164 to lateral portion 162 and across rearward portion 166. As fastening member 200 is tightened, lateral portion 162, medial portion 164 and rearward portion 166 are pulled inwardly to provide a better fit and increased support for heel 902. This can help retain heel 902 in article 100 and can help reduce the occurrence of over-pronation.

In some cases, to facilitate ease of removing foot 900 from article 100, fastening member 200 can be disengaged from either first fastener receiving portion 222 or second fastener receiving portion 224. In some cases, fastening member 200 may be disengaged from both first fastener receiving portion 222 and second fastener receiving portion 224. In the case where fastening member 200 is disengaged from both receiving portions, fastening member 200 may still be secured to support member 150 through its engagement within third fastener receiving portion 226.

In some embodiments, fastening member 200 could be permanently attached to either lateral portion 162 and/or medial portion 164. In cases where fastening member 200 is permanently attached to both lateral portion 162 and medial portion 164, fastening member 200 may expand as a heel is inserted into upper 102. In such cases, fastening member 200 need not be engaged and disengaged to fasten support member 150 around the heel.

The configurations discussed above provide a support member that may serve as a heel counter in an article of footwear. Moreover, the support member is configured to accommodate heels of different sizes, including different widths. This allows a manufacturer to utilize a single heel counter for a variety of different heel widths, rather than making a single heel counter for each heel width. Furthermore, this design accommodates intermediate heel widths that would otherwise not be accommodated, since the support member can adjust to width or size within a given range of sizes.

Figure 11:
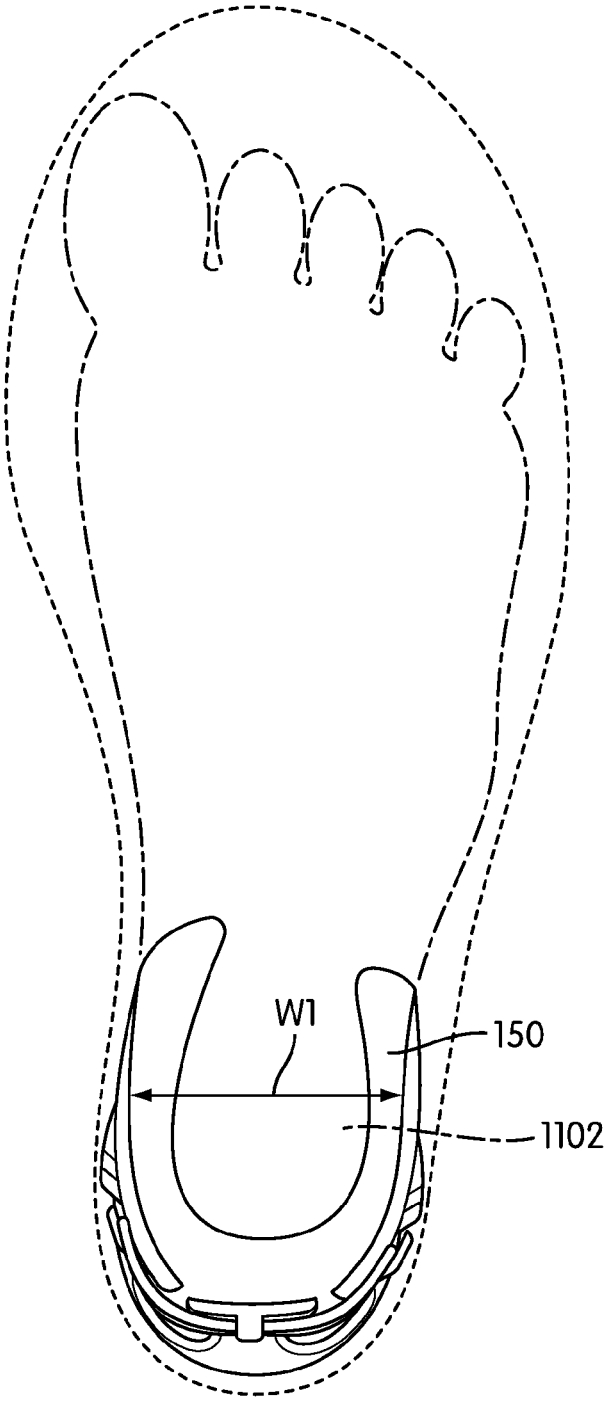
FIG. 11 is a top-down view of an embodiment of an adjustable heel member for a foot with a narrow heel width.
Figure 12:
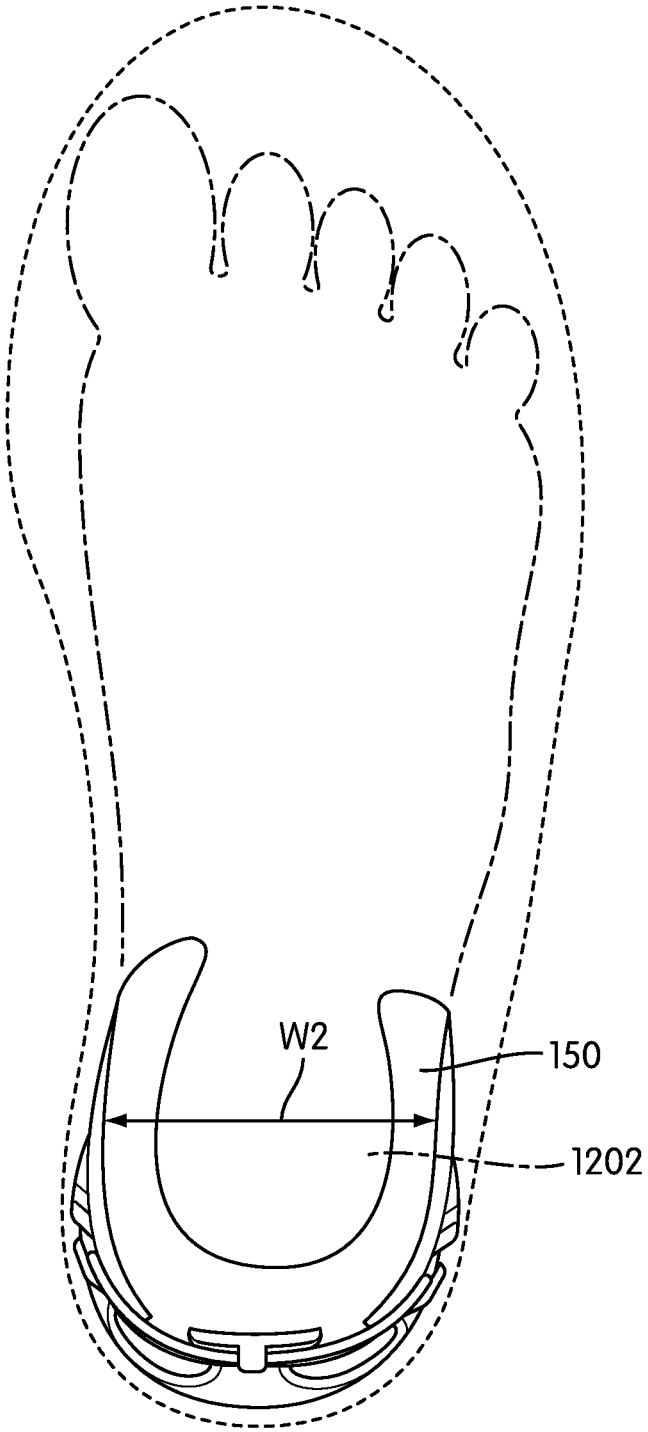
FIG. 12 is a top-down view of the adjustable heel member of FIG. 11 adjusted to fit a foot with a medium heel width.
Figure 13:
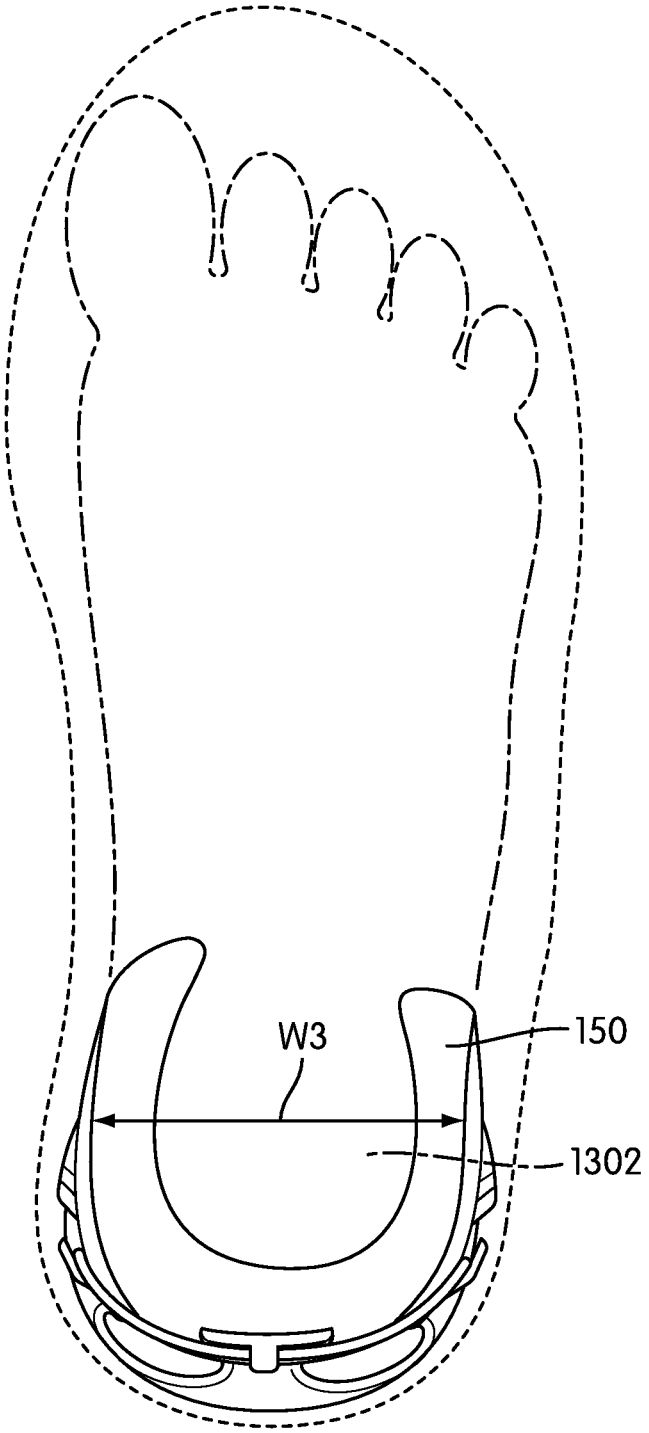
FIG. 13 is a top-down view of the adjustable heel member of FIG. 11 adjusted to fit a foot with a wide heel width.

FIGS. 11 through 13 illustrate schematic views of support member 150 configured to accommodate a range of different heel widths. Referring to FIGS. 11 through 13, support member 150 is capable of expanding to fit different heel widths of width W1, width W2 and width W3. In particular, in a first fastened position shown in FIG. 11, support member 150 accommodates a relatively narrow width W1 associated with heel 1102. In the fastened position shown in FIG. 12, support member 150 accommodates a medium width W2 associated with heel 1202. In the fastened position shown in FIG. 13, support member 150 accommodates a wide width W3 associated with heel 1302.

Support member 150 can be made from a variety of different materials. Examples of different materials that could be used for one or more portions of support member 150 include, but are not limited to: plastic, natural leather, synthetic leather, rubber, plastic, woven materials, foams, as well as any other materials known in the art. Moreover, in some other embodiments, different portions of support member 150 could be made of different materials. Fastening member 200 can also be made from a variety of different materials.

Examples of different material that could be used for fastening member 200 include, but are not limited to: elastic materials, rubber, woven materials as well as any other materials.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A heel support member for an article of footwear, comprising:

a base portion;

a first side portion extending from the base portion;

a second side portion extending from the base portion, the second side portion being disposed opposite of the first side portion;

a rearward portion extending from the base portion;

the first side portion being spaced apart from the rearward portion and the second side portion being spaced apart from the rearward portion;

a fastening member extending from the first side portion to the second side portion, wherein the fastening member engages the rearward portion and provides tension between the first side portion, the rearward portion and the second side portion;

wherein the first side portion includes a fastener receiving portion;

wherein the fastener receiving portion includes an engaging portion that is spaced apart from an outer surface of the first side portion, and wherein the fastener receiving portion includes a connecting portion that connects the engaging portion to the outer surface of the first side portion;

wherein the connecting portion is disposed closer to the rearward portion of the heel support member than the engaging portion so that the fastener receiving portion is a hook for engaging the fastening member;

the engaging portion includes an engaging surface oriented away from the rearward portion, wherein the engaging portion includes a recess disposed between a portion of the engaging surface having a free end and the outer surface of the first side portion;

wherein a portion of the fastening member is releasably held at least partially in the recess when the fastening member is fastened to the first side portion; and wherein the fastening member is a continuous loop of elastic.

2. The heel support member according to claim 1, wherein the heel support member is configured to fit onto a heel portion of an upper.

3. The heel support member according to claim 1, wherein the base portion is disposed between an upper and a sole structure of the article of footwear.

4. The heel support member according to claim 1, wherein the engaging portion and the connecting portion are configured in a T-like shape.

5. The heel support member according to claim 1, wherein the fastener receiving portion is oriented so that the connecting portion is disposed closer to the rearward portion than to the engaging portion.

6. A heel support member for an article of footwear, comprising:

a base portion and an extended portion that extends away from the base portion;

the extended portion having a first gap that separates a first side portion of the extended portion from a rearward portion of the extended portion;

the extended portion having a second gap that separates a second side portion of the extended portion from the rearward portion;

the first side portion having a first end portion and a second end portion, wherein the first end portion is disposed proximate the base portion and the second end portion extends across an upper part of the first gap towards the rearward portion;

the first side portion having a forward most edge that is exposed along a forward most portion of the heel member and extends from the first end portion to the second end portion;

the first side portion having a rearward most edge that is exposed to the first gap and extends from the first end portion to the second end portion;

wherein the forward most edge is at least as long as the rearward most edge so that the first side portion can is designed to flex substantially about the base portion;

a fastening member including a first portion and a second portion;

the first portion of the fastening member being engaged with a first fastener receiving portion on the first side portion and the second portion of the fastening member being engaged with a second fastener receiving portion on the second side portion; and wherein the first portion of the fastening member can be disengaged from the first fastener receiving portion.

7. The heel support member according to claim 6, wherein the first fastener receiving portion is disposed between the forward most edge of the first side portion and the rearward most edge of the first side portion.

8. The heel support member according to claim 6, wherein the first gap has a first portion closest to the base portion and a second portion that is disposed further from the base portion than the first portion, and wherein the first portion of the first gap is wider than the second portion of the first gap.

9. The heel support member according to claim 6, wherein the second portion of the fastening member can be disengaged from the second fastener receiving member.

10. The heel support member according to claim 6, wherein the first side portion can bend with respect to the base portion.

11. The heel support member according to claim 6, wherein the second side portion can bend with respect to the base portion.

12. The heel support member according to claim 6, wherein the rearward portion can bend with respect to the base portion.

13. A heel support member for an article of footwear, comprising:

a base portion;

an extended portion extending from the base portion, the extending portion including a first side portion, a second side portion and a rearward portion;

an elastic fastening member including a first portion and a second portion, wherein the elastic fastening member is a single continuous loop;

the first portion being attached to the first side portion of the extended portion and the second portion being attached to the second side portion of the extended portion;

wherein the first side portion is spaced apart from the rearward portion by a first gap and wherein the second side portion is spaced apart from the rearward portion by a second gap;

wherein the rearward portion has a first side edge exposed to the first gap and wherein the rearward portion has a second side edge exposed to the second gap;

wherein the rearward portion includes a rear fastener receiving portion, the rear fastener receiving portion extending outwardly from the rearward portion and enclosing a portion of the elastic fastening member;

wherein the first portion of the elastic fastening member extends away from the rear fastener receiving portion towards the first side portion and bridges the first gap and the second portion of the elastic fastening member extends away from the rear fastener receiving portion towards the second side portion and bridges the second gap;

wherein a first spacing between the first side portion and the rearward portion can vary to accommodate different footwear sizes within the article of footwear; and wherein a second spacing between the second side portion and the rearward portion can vary to accommodate different footwear sizes within the article of footwear.

14. The heel support member according to claim 13, wherein the first gap has a first portion closest to the base portion and a second portion that is disposed further from the base portion than the first portion, and wherein the first portion of the first gap is wider than the second portion of the first gap.

15. The heel support member according to claim 13, wherein the first side portion has a first end portion and a second end portion, wherein the first end portion is disposed proximate the base portion and the second end portion extends across an upper part of the first gap towards the rearward portion.

16. The heel support member according to claim 13, wherein the first side portion of the extended portion includes a fastener receiving portion configured to engage the elastic fastening member, wherein the fastener receiving portion is a hook.

17. The heel support member according to claim 16, wherein the fastener receiving portion includes a connecting portion and an engaging portion that attaches to the connecting portion.

18. The heel support member according to claim 17, wherein a longest dimension of the engaging portion is oriented perpendicular to a longest dimension of the connecting portion.

19. The heel support member according to claim 18, wherein the first side portion of the elastic fastening member is configured to wrap around the engaging portion and thereby be held in tension by the fastener receiving portion.

* * * * *